US005463835A

United States Patent [19]

Wood

[11] Patent Number: 5,463,835

[45] Date of Patent: Nov. 7, 1995

[54] MOLDING ASSEMBLY

[75] Inventor: James Wood, Williamsport, Pa.

[73] Assignee: D/P, Inc., Williamsport, Pa.

[21] Appl. No.: 246,100

[22] Filed: May 19, 1994

[51] Int. Cl.[6] ..... E04F 19/02

[52] U.S. Cl. ..... 52/288.1; 52/718.05

[58] Field of Search ..... 52/287.1, 288.1, 52/718.05, 718.06, 718.04, 718.01, 586.1; D25/136, 137

[56] References Cited

U.S. PATENT DOCUMENTS

| | | | |
|---|---|---|---|
| 303,356 | 8/1884 | Beck . | |
| 1,426,277 | 8/1922 | Conant . | |
| 1,430,996 | 10/1922 | Horlin | 52/718.01 X |
| 1,825,010 | 9/1931 | Murphy | 52/288.1 |
| 2,116,846 | 7/1936 | Pilcher | 20/74 |
| 2,981,988 | 5/1961 | Schweitzer | 20/74 |
| 3,298,147 | 1/1967 | Haberman | 52/288.1 |
| 3,302,350 | 2/1967 | Brown et al. | 52/288.1 |
| 3,481,092 | 12/1969 | Constantino | 52/287.1 |
| 3,616,587 | 11/1971 | Schlafly, Jr. | 52/287.1 |
| 3,956,861 | 5/1976 | Rasmussen | 52/288.1 |
| 5,348,066 | 9/1994 | Wilson | 52/288.1 X |

FOREIGN PATENT DOCUMENTS

| | | | |
|---|---|---|---|
| 679523 | 10/1966 | Belgium | 52/287.1 |
| 2300192 | 9/1976 | France | 52/287.1 |

OTHER PUBLICATIONS

Adriatic Wood Products, Inc. Architects and Interior Decorators Designer Style Book of Genuine Hardwood (24 pages) (undated).

Anderson Wood, "Morgan Distribution" Brochure (24 pages) (undated).

Armstrong World Industries, Inc. "Finishing Touches" Brochure (8 pages) (1993).

The James Wood Company Selectrim Applications Brochure (4 fold 2 One-Half Pages) (1991).

*Primary Examiner*—Carl D. Friedman
*Assistant Examiner*—Laura A. Saladino
*Attorney, Agent, or Firm*—Thomas Hooker

[57] ABSTRACT

A molding assembly including an elongate crown molding member having a trim mounting groove on the outer surface extending along the bottom of the member opposite a mounting surface on the inner surface, and a trim molding member mounted on the crown molding member in the groove. A fastening member extending from the bottom of the groove through the crown molding member secures the assembly to a vertical wall.

3 Claims, 4 Drawing Sheets

MOLDING ASSEMBLY

FIELD OF THE INVENTION

The invention relates to decorative molding assemblies mounted on vertical surfaces.

DESCRIPTION OF THE PRIOR ART

Conventional crown molding is mounted on a vertical wall or surface, angles out from the wall and engages a ceiling a distance away from the wall. The molding includes a one-piece crown molding with decorative features on the outer surface of the crown molding, a vertical mounting surface on the lower inner surface adjacent the lower end of the molding and a horizontal mounting surface on the upper inner surface adjacent the top of the molding. The molding is secured on the wall by fasteners, typically nails.

SUMMARY OF THE INVENTION

The invention is an improved molding assembly including a free standing crown molding member having a vertical mounting surface on the lower end of the inner surface and a trim mounting groove formed in the decorative outer surface of the member and overlying the mounting surface. A recess at the top of the groove extends into the portion of the member angling out from the wall. The member is secured in place on the vertical wall by driving fasteners extending through the bottom of the groove and into the wall. The recess provides lateral space above the groove to permit tooling to be positioned sufficiently close to the member to drive the fasteners in place.

The groove is located over the upper end of the mounting surface. When fasteners are driven through the crown molding member in the center of the groove, the fasteners are located approximately ¾ of the way up the height of the supporting surface. In this way, a sufficient length of supporting surface extends below the fasteners to provide support for the molding assembly.

The mounting groove and the recess above the groove reduce the thickness of the crown molding member. The remaining thickness of the crown molding member is sufficient to support the freestanding assembly without sagging of the upper end of the assembly away from the ceiling. Sagging causes undesirable gaps between the upper end of the assembly and the ceiling.

A trim member is secured in the groove to cover the ends of the fastening members and provide a desired decorative appearance to the assembly. Trim members having different decorative features may be fitted, as required, in order to vary the appearance of the assembly. The moulding and trim members are preferably painted before installation.

An angled groove is formed in the top of the crown molding member to facilitate alignment of joints between the unsupported upper ends of abutting lengths of molding members. A spline is fitted in the adjacent grooves and extends across the joint to align the members.

In a second embodiment, an elongate trim member is mounted on the upper end of a freestanding crown molding member. The upper trim member is provided with a groove overlying the groove in the top of the crown molding member. A wide spline is fitted in both grooves to secure the trim member on the freestanding end of the crown molding member.

In a third embodiment, a bracket secured to the vertical wall in the recess behind the crown molding member extends into the groove at the top of the member to support the top of the assembly.

Other objects and features of the invention will become apparent as the description proceeds, especially when taken in conjunction with the accompanying drawings illustrating the invention, of which there are four sheets and three embodiments.

DESCRIPTION OF THE PREFERRED EMBODIMENTS

First Embodiment

Figure 1:
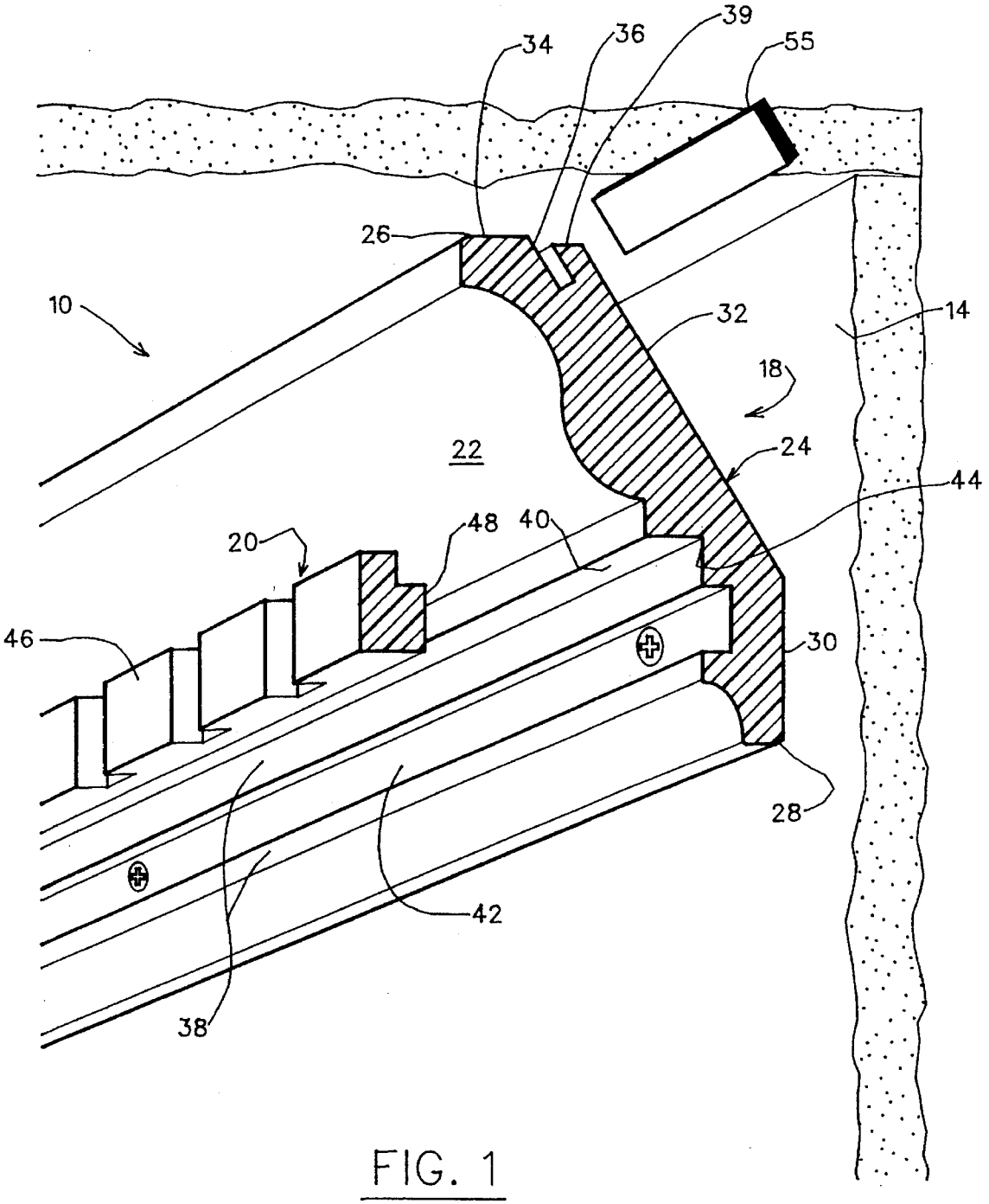
FIG. 1 is a perspective view of a first embodiment molding assembly according to the invention.
Figure 2:
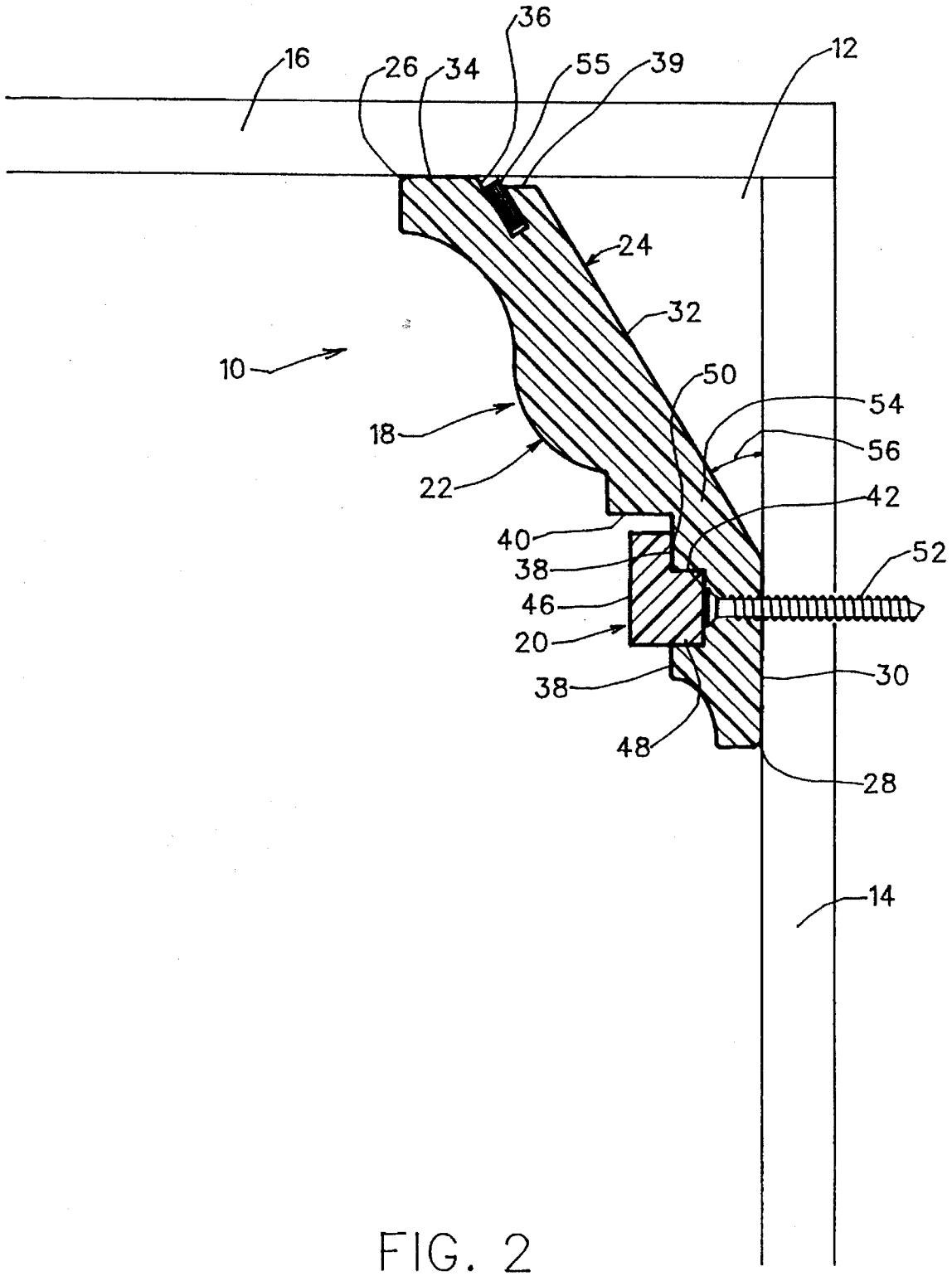
FIG. 2 is a transverse sectional view of the molding assembly in FIG. 1.

As illustrated in FIGS. 1 and 2, the first embodiment molding assembly 10 trims the upper corner 12 of a room at the intersection of ceiling 16 and vertical wall 14. The assembly 10 includes an elongate uniform cross section crown molding member 18 which extends across the corner 12 and engages the interior surfaces of wall 14 and ceiling 16. Elongate trim member 20 extends along and is mounted on the lower end of member 18. Both members 18 and 20 may be made of wood, as illustrated in the drawings, or may be made of molded or extruded plastic, composition material or other suitable material. The outer surface 22 of member 18 is shaped to present a pleasing appearance. The outer surface of member 20 is likewise shaped to present a pleasing appearance. Dental trim is illustrated. Alternatively, the outer surface of member 20 may be rounded to present a bead, may be patterned in an egg and dart design or may be square or angular in shape. The inner side of trim member 20 facing member 18 has a uniform cross section.

Crown molding member 18 includes outer surface 22 facing away from corner 12 and an inner surface 24 facing toward the corner 12 with the surfaces joining each other at upper corner 26 and lower corner 28. The inner surface 24 includes an inner vertical mounting surface 30 extending along the inner surface of wall 14, diagonal surface 32 angling up and away from the wall 14 at an acute angle and toward ceiling 16, and a horizontal mounting surface 34 at the top of the member adjacent upper corner 26. Angled groove 36, parallel to diagonal surface 32, extends along the length of the top of crown molding member 18 inwardly of mounting surface 34. Recessed surface 39, parallel to surface 34 but located a distance below surface 34, extends from the upper edge of surface 32 to groove 36. The angle of groove 36 parallels surface 32 to facilitate forming the groove and the surface in one pass of member 18 through a forming machine.

The outer surface 22 of crown molding member 18 includes an outer mounting surface 38 which extends parallel to and overlies the inner vertical mounting surface 30. The upper end of surface 38 joins horizontal outwardly extending surface 40 to define a recess 44 in surface 22. A trim mounting groove 42 is formed in outer mounting surface 38 and overlies inner mounting surface 30, as shown in FIG. 2. The center of groove 42, between adjacent groove edges, is located a distance approximately 75 percent of the height of inner vertical surface 30 so that 75 percent of the height of the surface is below the fasteners holding the member to wall 14. The upper corner of groove 42 and the bottom of recess 44 are spaced the same distance from surface 32 to maintain the strength of member 18.

The portion of surface 22 extending from lower corner 28 to surface 38 and from surface 40 to the upward corner 26 are shaped to provide a pleasing appearance. The outer surface of molding member 18 is generally shaped to simulate an ogee molding. Other shapes may be used as desired, including a cove molding in which the upper portion of the surface above surface of the molding has a concave shape and a bevel molding shape in which the upper surface is flat and parallels surface 32.

Elongate trim member 20 includes a decorative surface 46 facing outwardly from member 18. The side of trim member 20 facing crown molding member 18 includes a rib 48 on the bottom of member 20 and an inwardly facing surface 50 at the top of the member. As shown in FIG. 2, trim member 20 is mounted on member 18 by seating rib 48 in mounting groove 42 with surface 50 seated flush on the top portion of mounting surface 38. If desired, the top of the trim member may rest flush against surface 40 to fill recess 44.

Crown molding member 18 is mounted in corner 12 as shown in FIGS. 1 and 2 by first positioning a length of the molding member in the corner with vertical mounting surface 30 flush on wall 14 and horizontal mounting surface 34 flush on ceiling 16. When held in this position, screws or other fasteners 52 are extended through the thickness of the lower portion of the member at the center of groove 42 as illustrated to engage the underlying wall 14. The fasteners 52 may be screws, as illustrated, nails or the like. Tooling used to drive the fastener extends into recess 44 and engage mounting surface 38. The fasteners 52 draw surface 30 flush against wall 14 at a point located 75 percent up the height of the surface 30 from corner 28. The upper end of the member is freestanding and not secured to the ceiling. In this way, the crown molding member 18 is securely and stably mounted on the wall with the upper surface 34 held flush against the ceiling 16. Groove 42 is vertically positioned on the lower end of member 18 to assure that the fasteners engage the wall 14 at 75 percent of the vertical height of surface 30 for optimum mounting. If the fastening point were located higher on the surface 30, the width of the groove 42 would extend into the width of the portion 54 of the member angling away from the wall, and weaken the mounting member. The weakness could permit downward sag of the freestanding top of the member 18. If the location of the fastening members were lowered appreciably, the effective bearing portion of surface 30 located below the fasteners would be reduced, once again creating the potential for sag.

The recessed surface 39 at the top of member 18 reduces the area of contact between the member and the ceiling and reduces the possibility that unevenness in the ceiling would prevent the upper end of the member from seating flush on the ceiling. If desired, the width of surface 34 may be reduced below that shown in the drawings to further reduce the possibility of surface unevenness on the ceiling preventing flush mounting of the molding member 18 at the top of the corner 26.

Crown molding member 18 is preferably formed from stock having a minimum thickness in order to reduce the cost of the member. Additional requirements for the member are that the member have sufficient strength to support the molding assembly against sag, have a sufficiently high support surface 30 for proper support and the member must angle outwardly from the supporting wall or surface at a sufficient angle to be attractive.

The diagonal surface 32 of molding member 18 extends outwardly from the surface of the wall 14 at an angle 56 of between 30 and 35 degrees. In order to maintain the stability and strength of the assembly supported by fasteners 52 at the bottom of the assembly the angle 56 must be less than 35 degrees. Further increase of the angle reduces the height of the mounting surface 30 below a minimum height capable to support the molding assembly using fasteners 52. Further, increase of angle 56 beyond 35 degrees reduces the thickness of the member 18 at the upper corner of groove 42 and at the bottom of recess 44 to weaken the member materially and render it incapable of supporting the assembly. Molding member 18 extends outwardly from the supporting wall at an angle of between 30 and 35 degrees, is formed of relatively thin stock, has a sufficient height support surface 30, is sufficiently strong at the recess 44 and groove 42 to prevent sag and is aesthetically pleasing.

A spline 55 may be seated in groove 36 at the ends of two members 18 in order to facilitate joining together two abutting member lengths. The upper ends of the members are not fastened to the ceiling and, in the absence of a spline 55 extending across the joint between the members, may not be positioned in exact alignment.

A coped length of member 18 may be joined to previously mounted length of member 18 at a wall corner of the room in order to extend a crown molding along adjacent angled walls and, if desired, completely around the walls of a room.

After member 18 has been secured to wall 14 by fasteners 52, mounting of assembly 10 is completed by positioning trim member 20 in the groove 42 of previously mounted molding member 18 as shown with rib 48 seated in the groove to cover the exposed ends of fastening members 52, and provide a finished appearance to the molding assembly. The height of the member 20 is greater than the width of groove 42 and appreciably fills recess 44. Trim member 20 is secured in the mounting groove 42 as shown in FIG. 2 by use of a suitable glue or adhesive. Small nails or brads may be used.

Second Preferred Embodiment

Figure 3:
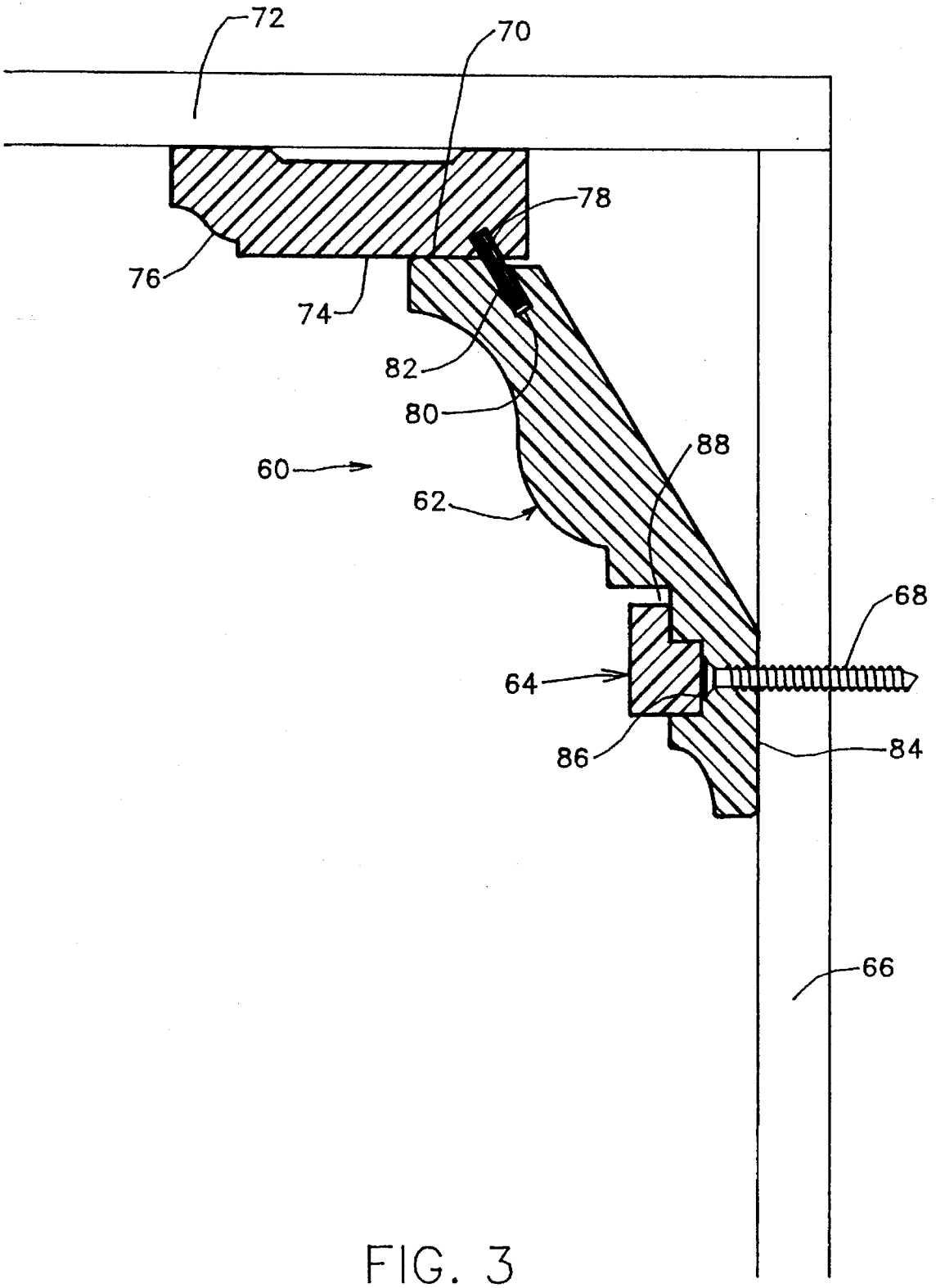
FIGS. 3 and 4 are transverse sectional views of second and third embodiments of the invention, respectively.

FIG. 3 illustrates a second molding assembly 60 including a crown molding member 62 and trim member 64 like members 20 and 22 of the first embodiment assembly. Member 62 is secured to vertical wall 66 by fasteners 68, similar to fasteners 52.

The horizontal mounting surface 70 of member 62 is spaced below ceiling 72 and rests flush on lower surface 74 of elongate top trim member 76. The crown molding member 62 sandwiches the top trim member 76 against the ceiling. An angled groove 78 extends into lower surface 74 above groove 80 in the top of member 62. Spline 82 is fitted in the grooves 78 and 80 to maintain the trim member 76 in proper alignment with the crown molding member 62, as illustrated. The entire molding assembly 60 is secured in place on wall 66 and against the ceiling 72 by the fasteners 68 which are spaced at intervals along the length of the lower portion of crown molding member 62. Trim member 76 may be secured to the ceiling by fasteners or may be solely supported by member 62.

Third Preferred Embodiment

Figure 4:
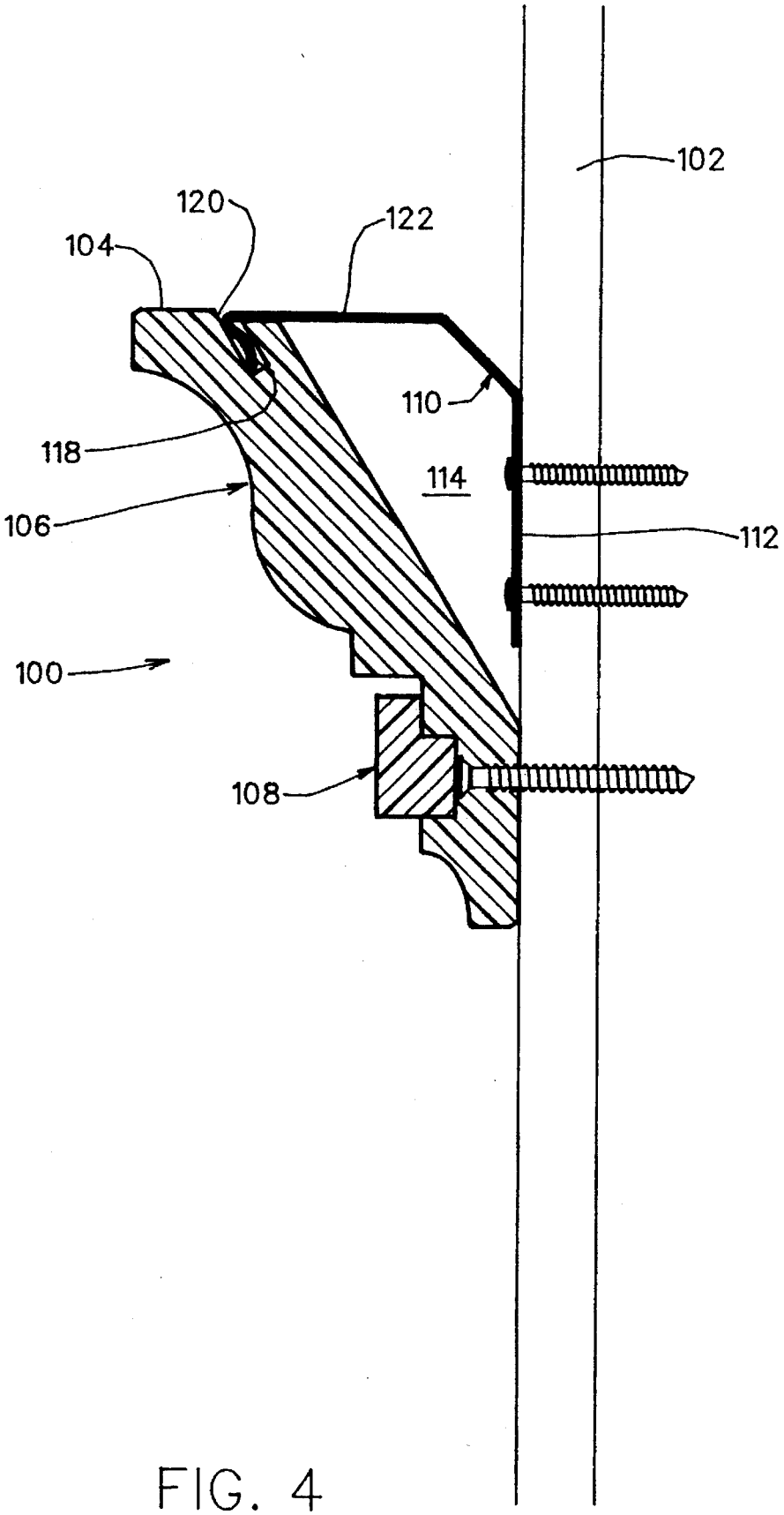

FIG. 4 illustrates a third preferred embodiment in which a molding assembly 100, like molding assembly 10, is mounted on vertical wall 102 a distance below the ceiling so that the upper surface 104 of the crown molding member 106 is below the ceiling. The lower end of member 106 is held in place on wall 102 as described in connection with the first embodiment and a trim member 108 is secured in place on the lower end of the member 106.

The upper end 104 of crown molding member 106 is supported by metal brackets 110 spaced along the length of the member. Each bracket 110 includes a vertical leg 112 secured to the wall 102 in the recess 122 behind crown molding member 106. The upper end of leg 112 joins horizontal leg 114 which extends over the top of recessed surface 116 at the inner top of member 106 as illustrated. A finger 118 on the outer end of leg 114 extends down and into angled groove 120 in surface 116. Brackets 110 hold the exposed upper end on top of the molding assembly in place to prevent accidental dislodgement and sag.

Brackets 110 may also be used to hold the upper ends of the first and second embodiment molding assemblies 100 in place, if desired. The recessed inner surfaces of the crown molding members permit the outer end of bracket leg 114 to extend freely to the recess without disturbing the fit of the members.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A molding assembly comprising,

A) a first elongate molding member of uniform transverse cross section, the member having an upper corner, a lower corner, an outer surface on one side of the member extending between the upper and lower corners, and an inner surface on the other side of the member extending between the upper and lower corners, the inner surface including a vertical support surface extending a vertical distance up from the lower corner to define a height and a diagonal surface joining the top of the support surface and extending away from the plane of the support surface at an acute angle above a trim mounting groove, the trim mounting groove formed in the outer surface and extending along the length of the member, the groove including an upper edge, a lower edge and a bottom, said groove bottom overlying the support surface with the center of the groove between the groove edges being located a distance above the lower corner equal to approximately 75 percent of the height of the support surface, and a recess extending into a support portion of the member, said support portion being located above the support surface and the groove, said recess including a generally horizontal surface located above the upper edge of the groove and an outer mounting surface extending between the horizontal surface and the groove upper edge; and B) an elongate trim member extending along the length of the molding member and having a height greater than the width of the groove, the trim member including a rib fitted in said groove, a portion of the trim member extending above the groove and into said recess, said portion of the trim member having an inner mounting surface engaging the molding member outer surface.

2. A molding assembly as in claim 1 wherein said diagonal surface extends away from the plane of the support surface at an angle of about 30 to 35 degrees.

3. A molding assembly as in claim 1 wherein both a corner formed between the upper edge and the bottom of the groove and a corner formed between the horizontal surface and the outer mounting surface of the recess are located approximately the same distance from the diagonal surface.

* * * * *